US008707849B1

(12) United States Patent
Root et al.

(10) Patent No.: US 8,707,849 B1
(45) Date of Patent: Apr. 29, 2014

(54) MODULAR MORTAR BASEPLATE

(75) Inventors: Joshua B. Root, Albany, NY (US); Peter O'Hara, Rensselaer, NY (US); Andrew G. Littlefield, Watervliet, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 348 days.

(21) Appl. No.: 13/164,019

(22) Filed: Jun. 20, 2011

(51) Int. Cl.
*F41F 1/06* (2006.01)

(52) U.S. Cl.
USPC ..... 89/37.05; 89/37.13; 89/37.12; 89/1.35

(58) Field of Classification Search
USPC ..... 89/37.05, 37.13, 37.12, 40.02, 1.35
See application file for complete search history.

(56) References Cited

U.S. PATENT DOCUMENTS 2,557,960 A * 6/1951 Gerhardt ..... 89/37.05
2,558,024 A * 6/1951 Weiss et al. ..... 89/37.05
4,762,047 A * 8/1988 Ibarra ..... 89/1.35

* cited by examiner

*Primary Examiner* — Stephen M Johnson
(74) *Attorney, Agent, or Firm* — Michael C. Sachs

(57) ABSTRACT

A modular mortar baseplate may include a top plate with an outer annular substantially planar portion and a recessed central portion. A socket may be disposed in the recessed central portion. A hub may be disposed beneath the recessed central portion. A plurality of legs may be connected to an underside of the top plate and to the hub. Each leg may include a pair of vertical portions, a horizontal portion, and a pair of rounded portions that join the pair of vertical portions to the horizontal portion. Each of the pair of rounded portions may have a radius that decreases in a radially inward direction.

15 Claims, 7 Drawing Sheets

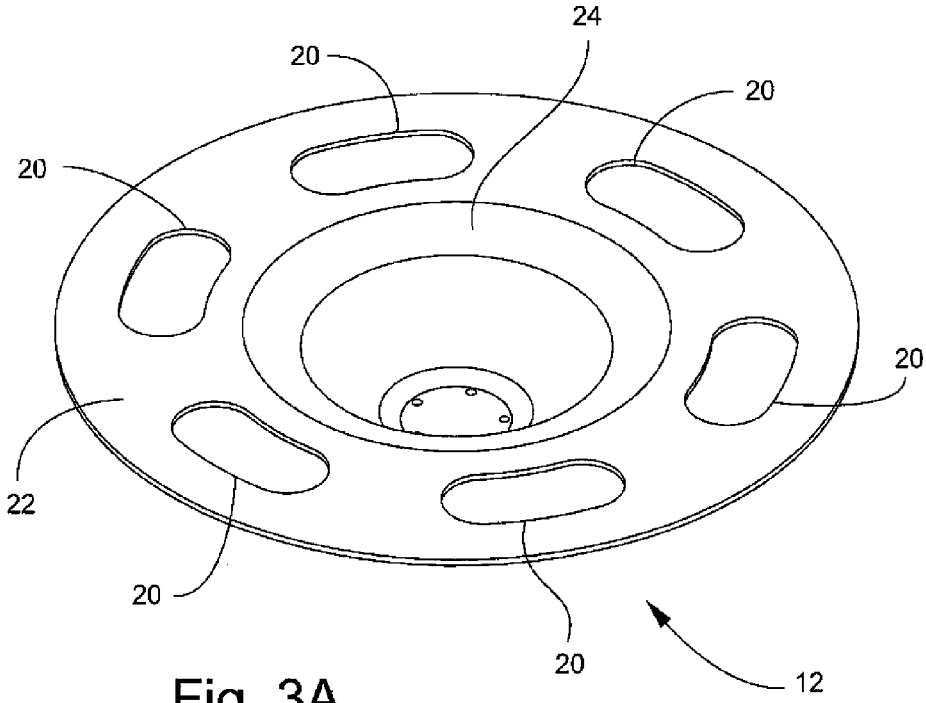
Fig. 3A
Fig. 3B
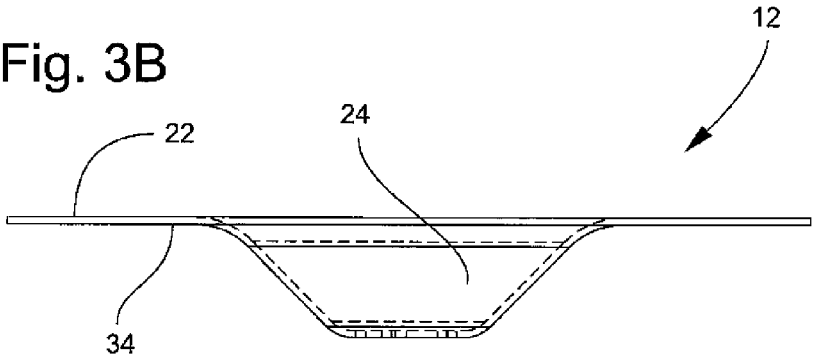

MODULAR MORTAR BASEPLATE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to mortar systems and in particular to baseplates for mortar systems.

Before mortar systems became crew-carried weapons, their recoil loads were absorbed by a large structure, such as a gun carriage. Large structures such as a gun carriage are too heavy to be carried by a single individual. The problem of absorbing recoil from mortar systems has existed since mortar systems became crew-carried weapons.

A baseplate may be used with a mortar system to absorb recoil. A baseplate may be small enough to be man-portable. A baseplate may provide an interface between a mortar gun tube and the ground to thereby allow the ground to absorb the recoil energy of the mortar gun tube.

Various baseplates designs have been used in the past. U.S. Pat. Nos. 2,765,707 and 2,558,024 disclose baseplate designs. Most baseplates have been solid metal castings or forgings. Known baseplates may be relatively heavy due to their all-metal, bulky construction. While known baseplates may adequately absorb recoil, they may be improved by decreasing their mass. Decreased mass means less of a burden on the person carrying the baseplate. Baseplates of lower mass have long been sought by users of crew-carried mortar systems.

Past efforts to construct a baseplate out of lighter weight composite materials have failed to produce a reliable baseplate. One problem with composite baseplate designs has been the joint between the legs and the top plate. In metal baseplates, the legs and top plate may be made from a single piece of material, so that there is no need to join the legs to the top plate. Composite baseplates, however, may not be cast or forged like metal baseplates A need exists for reliable, low mass baseplates for mortar systems.

SUMMARY OF THE INVENTION

It is an object of the invention to provide a reliable, low mass baseplate for a mortar system.

One aspect of the invention is a modular mortar baseplate. The baseplate may include a top plate having an outer annular substantially planar portion and a recessed central portion. A socket may be disposed in the recessed central portion. A hub may be disposed beneath the recessed central portion. A plurality of legs may be connected to an underside of the top plate and to the hub. Each leg may include a pair of vertical portions, a horizontal portion, and a pair of rounded portions that join the pair of vertical portions to the horizontal portion.

The pair of rounded portions may have a radius that decreases in a radially inward direction. The radius at a most radially distal portion of the rounded portions may be no more than about one-half a height of the legs. The radius at a most radially proximal portion of the rounded portions may be the greater of about twice a thickness of the vertical portion of the legs and about 0.25 inches.

The horizontal portion of each of the legs may be substantially contiguous with an underside of the outer annular substantially planar portion of the top plate. Adjacent legs may include substantially contiguous vertical portions. A portion of each of the legs that is radially inward of the horizontal portion of each of the legs may be contiguous with the recessed central portion of the top plate.

The hub may include slots for receiving radially proximal vertical portions of two adjacent legs.

The top plate and the plurality of legs may comprise a composite material.

Another aspect of the invention is a method of making a baseplate. The method may include separately fabricating a top plate and a plurality of legs, and then joining the plurality of legs to the top plate. Joining the plurality of legs to the top plate may include joining horizontal portions of each leg to an underside of the top plate.

The method may include abutting together vertical portions of adjacent legs. A portion of each of the legs that is radially inward of the horizontal portion of each of the legs may be joined to a recessed central portion of the top plate.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIGS. 3A and 3B are perspective and front views, respectively, of the top plate of the baseplate in FIGS. 1A-B.

DETAILED DESCRIPTION OF THE PREFERRED EMBODIMENTS

A modular mortar baseplate may: 1) have 40% or greater reduction in mass compared to known baseplates; 2) meet the same performance metrics as known baseplates; 3) have the same space claim as known baseplates; 4) have the same or a greater projected surface area on the ground as known baseplates; 5) have a toughness similar to known baseplates; and 6) have a resistance to damage similar to known baseplates. A lower mass baseplate may decrease the burden on the person carrying the baseplate. Decreasing the burden may increase the person's stamina or may allow the person to carry other important items that would exceed overall weight limits if a known baseplate were being carried rather than a modular mortar baseplate.

Figure 1A:
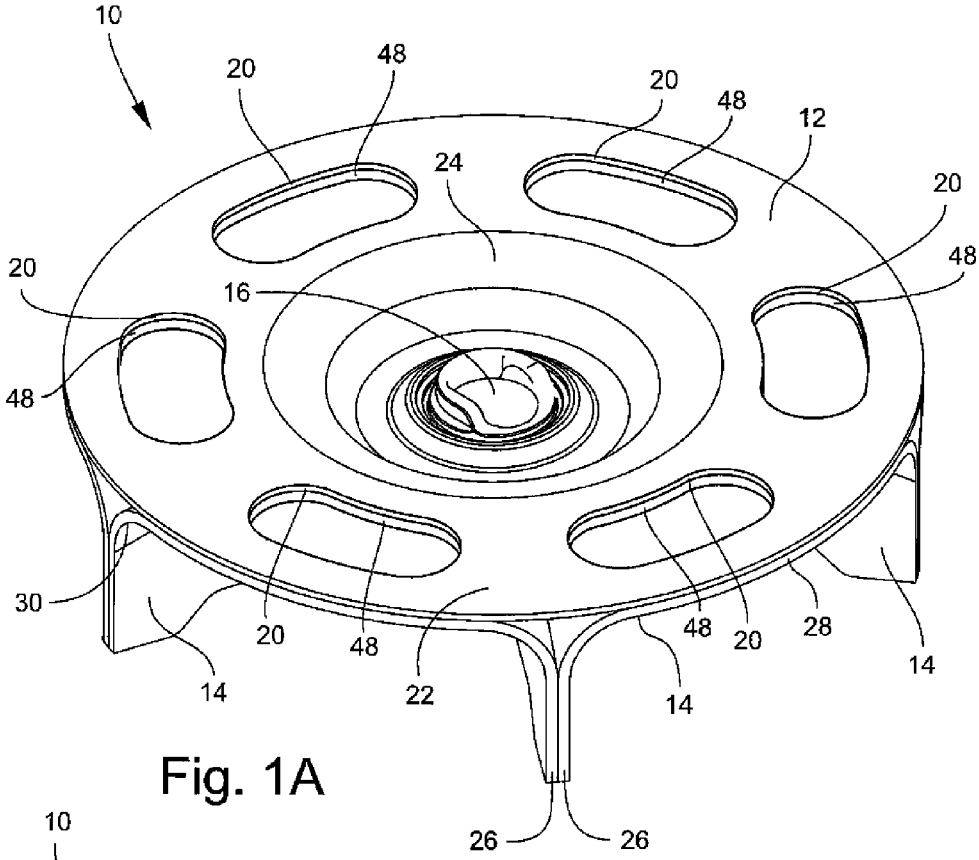
FIGS. 1A and 1B are perspective and front views, respectively, of one embodiment of a modular mortar baseplate.
Figure 1B:
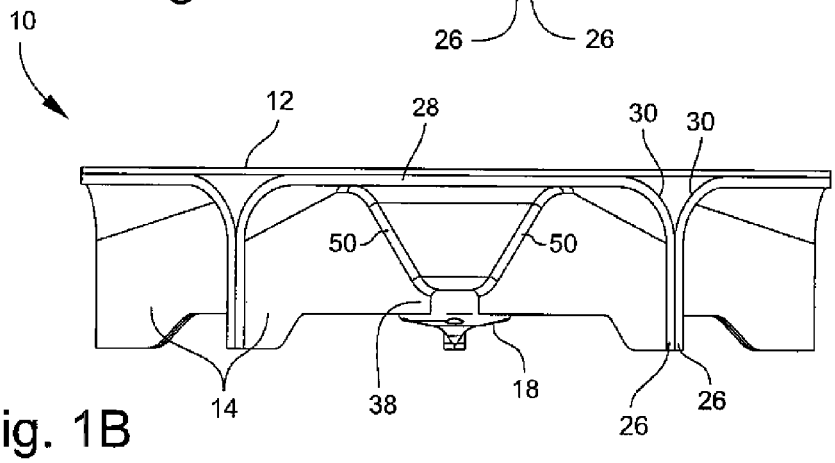
Figure 2A:
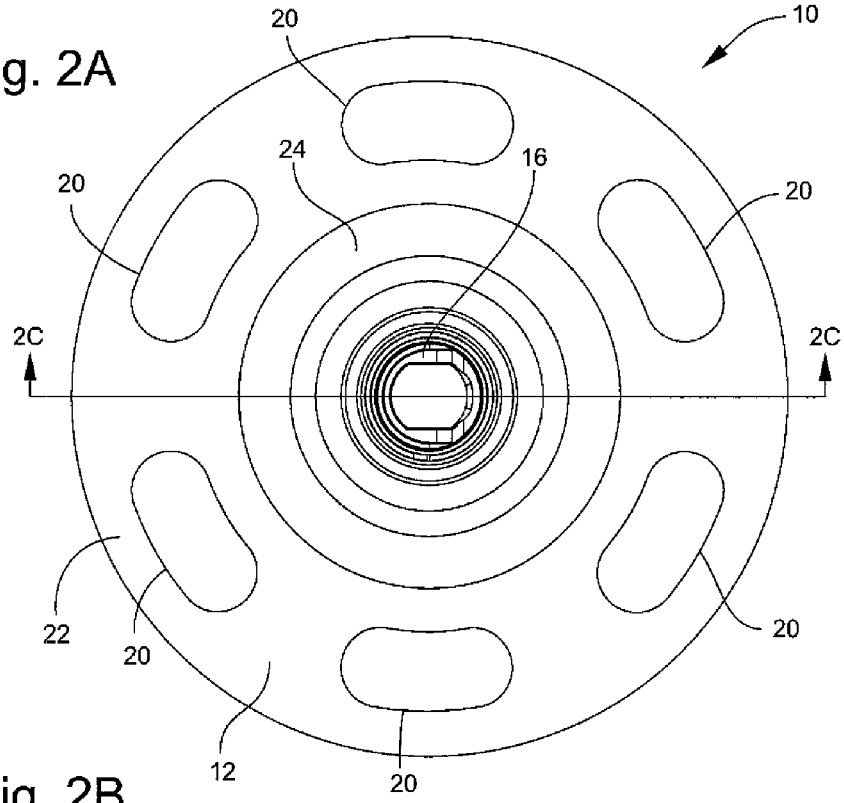
FIGS. 2A, 2B, and 2C are top, front, and sectional views, respectively, of the baseplate of FIGS. 1A-B. The view in FIG. 2C is along the line 2C-2C of FIG. 2B.
Figure 2B:
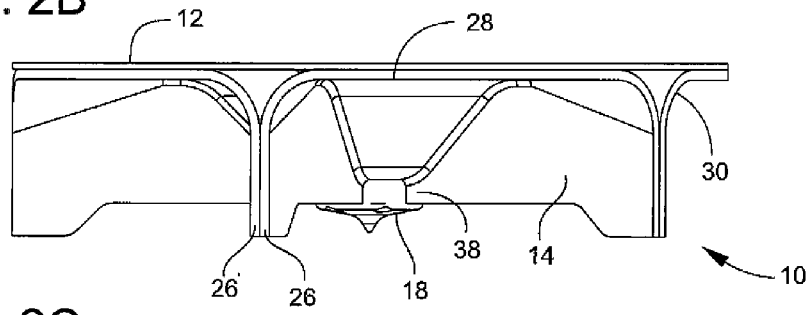
Figure 2C:
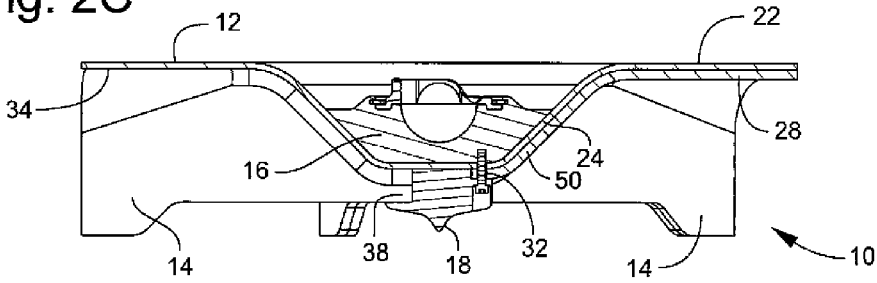

FIGS. 1A and 1B are perspective and front views, respectively, of one embodiment of a modular mortar baseplate 10. FIGS. 2A, 2B, and 2C are top, front, and sectional views, respectively, of baseplate 10 of FIGS. 1A-B. In FIGS. 2A-C, baseplate 10 is rotated counterclockwise some from its position in FIGS. 1A-B.

A modular mortar baseplate 10 may include a top plate 12, a plurality of legs 14, a socket 16, and a hub 18. Top plate 12 may include openings 20 therein. Openings 20 may decrease the mass of top plate 12. Socket 16 may receive the ball joint located at the end of a mortar cannon. Legs 14 may be positioned under and connected to top plate 12. Hub 18 may provide additional ground contact surface. Legs 14 may be connected to hub 18. If baseplate 10 were used with an 81 mm mortar cannon, then the overall diameter of baseplate 10 may be, for example, about twenty to about twenty-two inches.

As seen in FIGS. 3A-B, top plate 12 may include an outer annular substantially planar portion 22 and a recessed central portion 24. Socket 16 may be disposed in recessed central portion 24. Hub 18 (FIG. 2C) may be disposed beneath recessed central portion 24. Legs 14 may be connected to an underside 34 of top plate 12 and to hub 18 (FIG. 2C).

Figure 4A:
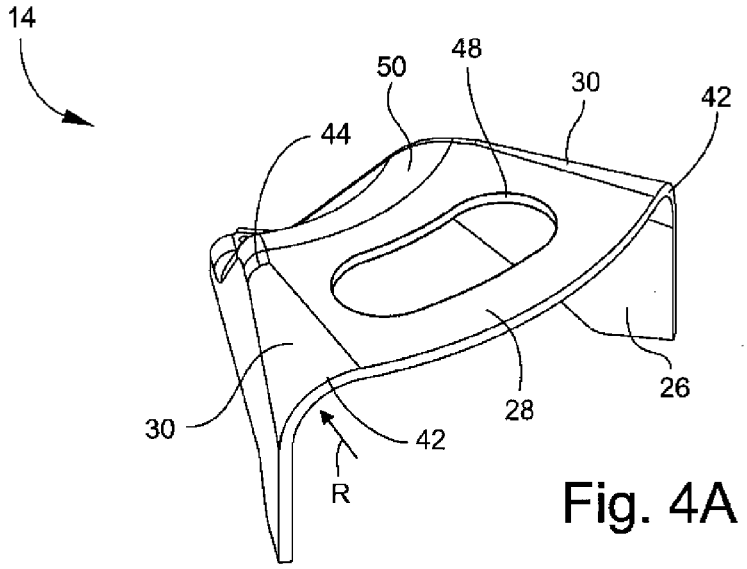
FIGS. 4A and 4B are perspective and front views, respectively, of a leg shown in FIGS. 1A-B.
Figure 4B:
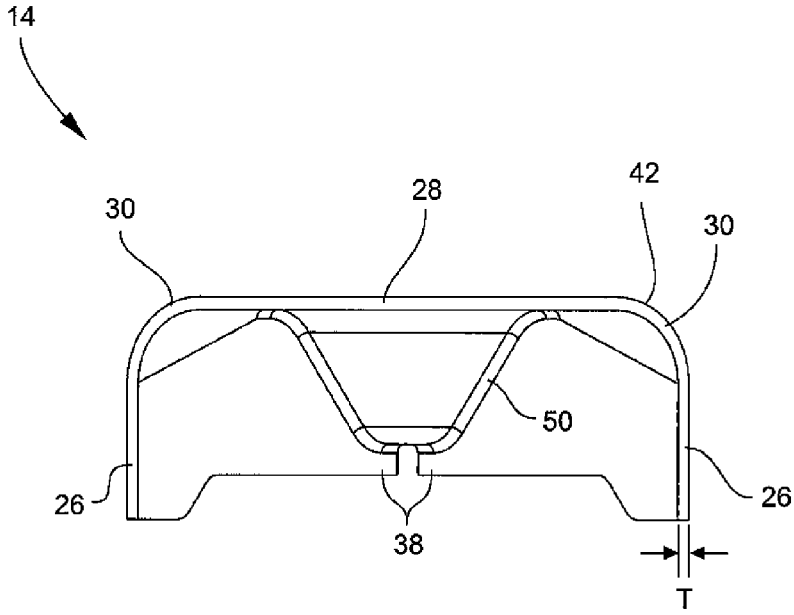
Figure 5A:
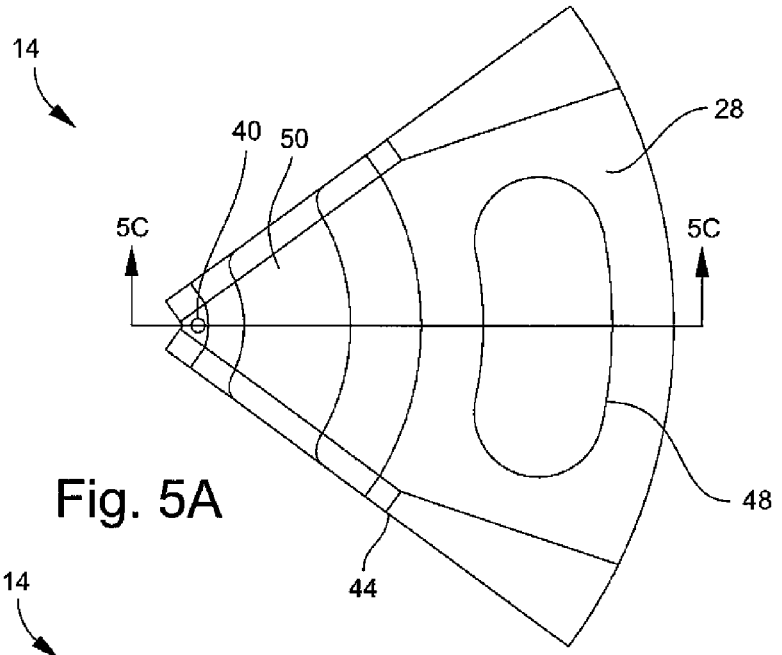
FIGS. 5A, 5B, and 5C are top, front, and sectional views, respectively, of the leg in FIGS. 4A-4B. The view in FIG. 5C is along the line 5C-5C of FIG. 5A.
Figure 5B:
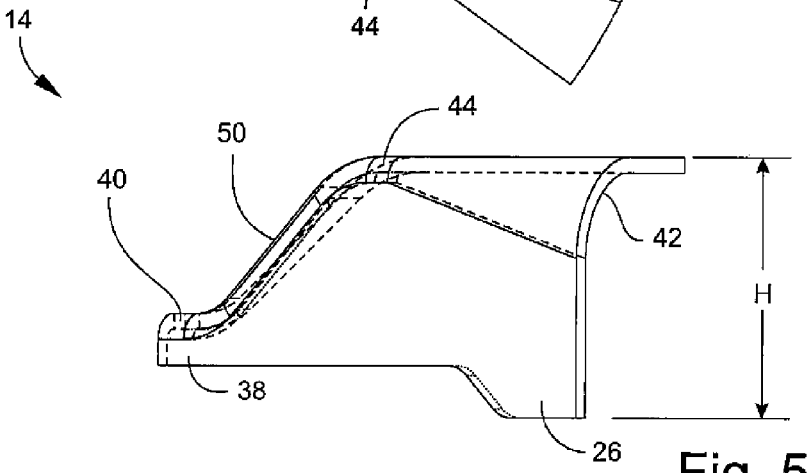
Figure 5C:
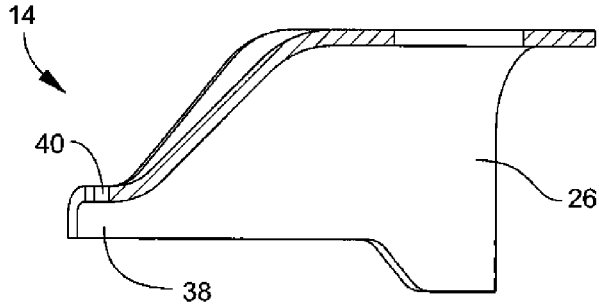

FIGS. 4A and 4B are perspective and front views, respectively, of a leg 14. FIGS. 5A, 5B, and 5C are top, front, and sectional views, respectively, of leg 14. Leg 14 may include one or more openings 48 that may align with or correspond to openings 20 in top plate 12. Leg 14 may include a pair of spaced-apart vertical portions 26, a horizontal portion 28, and a pair of rounded portions 30 that join vertical portions 26 to horizontal portion 28. Rounded portions 30 may have a radius R (FIG. 4A) that decreases in a radially inward direction.

Radius R at a most radially distal portion 42 of rounded portion 30 may be no more than about one-half a height H of leg 14. An exemplary height H of leg 14 may be, for example, about five to about six inches. Radius R at a most radially proximal portion 44 of rounded portion 30 may be the greater of about twice a thickness T of vertical portion 26 of leg 14 and about 0.25 inches. An exemplary thickness T of vertical portion 26 may be, for example, about one eighth to about three eighths of an inch.

Referring again to FIGS. 1A-B and 2A-C, and as best seen in FIG. 2C, horizontal portion 28 of each leg 14 may be substantially contiguous with underside 34 of outer annular substantially planar portion 22 of top plate 12. As shown in FIG. 2C, portion 50 of leg 14 that is radially inward of horizontal portion 28 may be contiguous with recessed central portion 24 of top plate 12. As seen in FIGS. 1A-B and 2B, adjacent legs 14 may include substantially contiguous vertical portions 26. FIG. 2C shows that top plate 12, socket 16, hub 18, and legs 14 may be joined by threaded fasteners 32. Bonding may be used to join top plate 12, socket 16, hub 18, and legs 14.

Figure 6A:
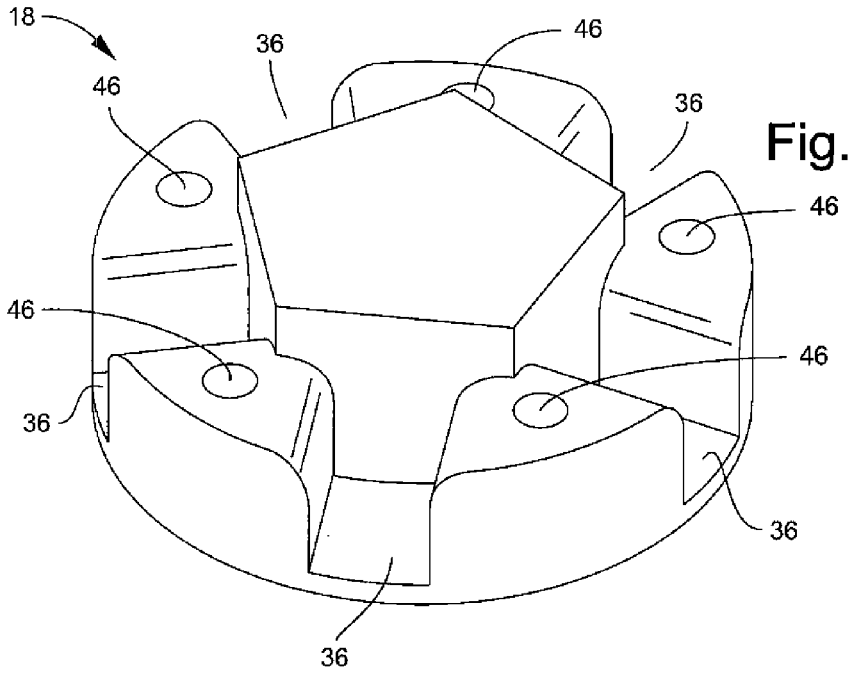
FIGS. 6A, 6B, and 6C are perspective, top, and sectional views, respectively, of the hub shown in FIGS. 1A-B. The view in FIG. 6C is along the line 6C-6C of FIG. 6B.
Figure 6B:
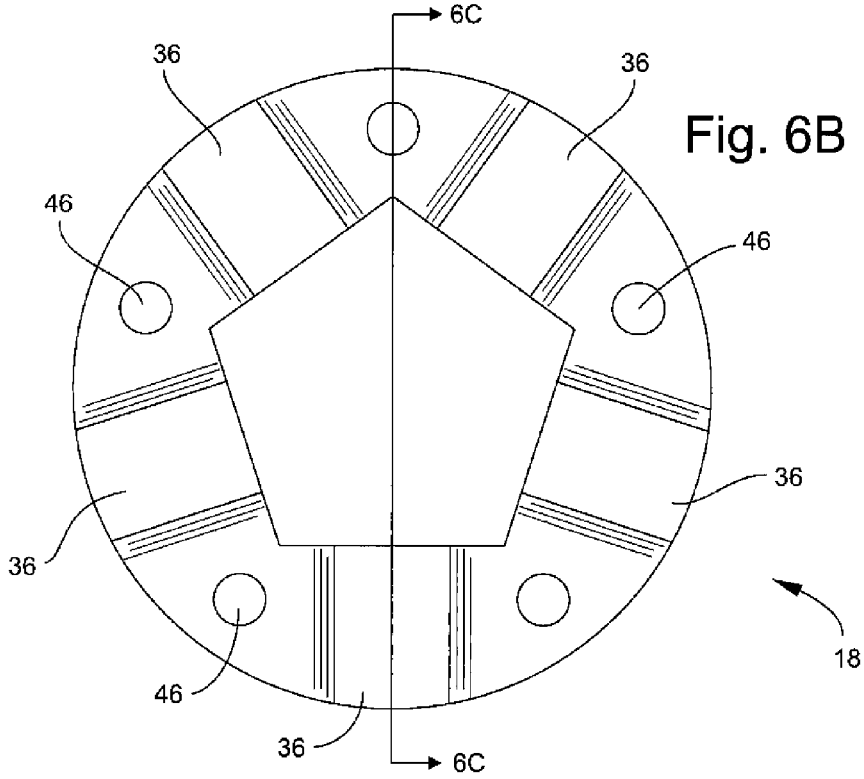
Figure 6C:
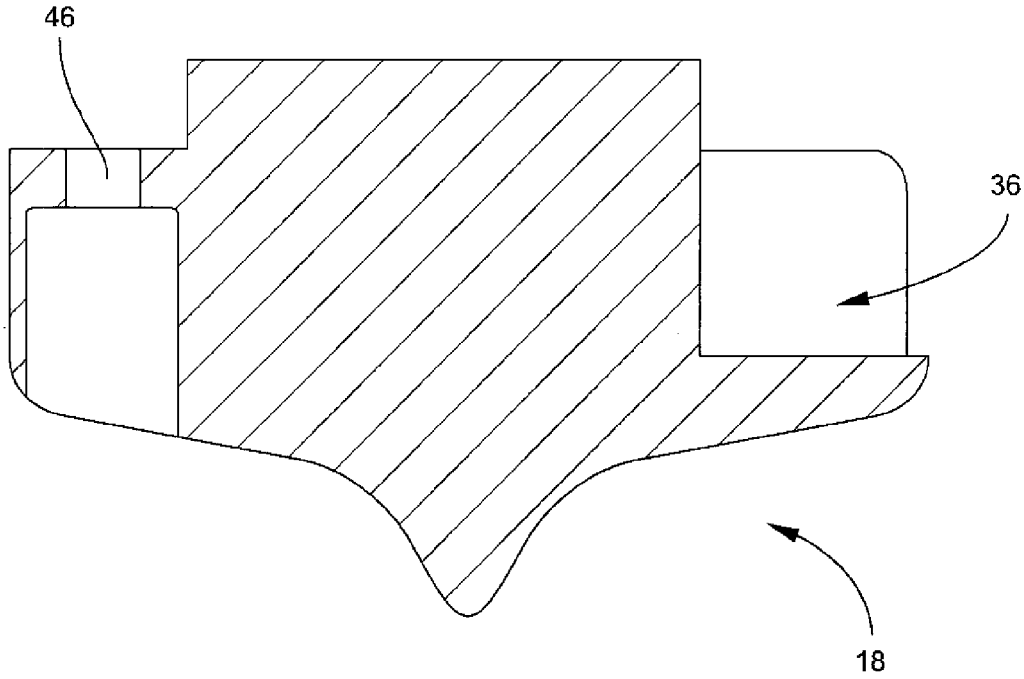

FIGS. 6A, 6B, and 6C are perspective, top, and sectional views, respectively, of hub 18. Hub 18 may include slots 36 for receiving radially proximal vertical portions 38 (FIGS. 1B, 2B, 2C, 4B) of adjacent legs 14.

Each leg 14 may include an opening 40 (FIGS. 5A-C) at a radially proximal portion for receiving threaded fastener 32. Hub 18 may include corresponding openings 46 (FIGS. 6A-C) for receiving threaded fasteners 32.

Socket 16 may first receive the recoil load of the cannon. All recoil load may pass through socket 16. Socket 16 may comprise, for example, aluminum. Socket 16 may be supported by top plate 12. Thus, recoil load from socket 16 may be transferred to top plate 12. Top plate 12 may transfer the recoil load to legs 14.

The configuration of legs 14 may allow the recoil load from the large surface area of top plate 12 to move into horizontal portions 28 of legs 14 and around and down radius R and into vertical portions 26 of legs 14. Vertical portions 26 of legs 14 may transfer the recoil load to the ground or other surface on which baseplate 10 is resting. The ground may absorb the recoil load. The resulting reaction force from the ground may move from vertical portions 26 of legs 14 up and around radius R and into horizontal portions 28 of legs 14 before transferring into top plate 12 over a large surface area. Radius R may reduce the stress concentration in legs 14 and in the joint between legs 14 and top plate 12. Radius R may allow legs 14 and the joint between legs 14 and top plate 12 to withstand the recoil loading.

As a result of the configuration of legs 14 and top plate 12, legs 14 and top plate 12 may be made of composite materials, rather than metal. The use of composite material may reduce the weight of baseplate 10. Legs 14 may be fabricated separately from top plate 12. Then, legs 14 may be bonded to top plate 12. Each leg 14 may be identical and sized such that the outermost edges of vertical portions 26 of adjacent legs 14 are flush with each other. The plurality of legs 14 may extend the full 360° beneath top plate 12.

The embodiment of baseplate 10 in the Figures includes five legs 14. However, fewer or more legs 14 may be used. In each case, horizontal portions 28 of each leg 14 may match or be contiguous with underside 34 of top plate 12. Legs 14 and top plate 12 may be bonded together after being separately fabricated. Socket 16 and hub 18 may be connected to top plate 12 and legs 14 with fasteners 32 and/or other methods, such as, for example, bonding.

Top plate 12 and legs 14 may be fabricated by a number of different techniques. For example, top plate 12 and legs 14 may be laid up by hand with prepreg composite, or dry fiber and resin, and then cured. Or, top plate 12 and legs 14 may be formed from flat composite sheets in a press. Or, top plate 12 and legs 14 may be laid up using tape placement. Other composite material fabrication methods may also be used. After top plate 12 and legs 14 are separately fabricated, they may be connected by bonding using epoxy, film adhesive, or other joining methods. Connecting top plate 12 and legs 14 by bonding may include aligning top plate 12 and legs 14 in a matched mold and then bonding them together.

If top plate 12 and legs 14 are made of metal, they may be stamped, machined, forged, or cast.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A modular mortar baseplate, comprising:

a top plate having an outer annular substantially planar portion and a recessed central portion;

a socket disposed in the recessed central portion;

a hub disposed beneath the recessed central portion; and a plurality of legs connected to an underside of the top plate and to the hub, each leg including a pair of vertical portions, a horizontal portion, and a pair of rounded portions that join the pair of vertical portions to the horizontal portion.

2. The baseplate of claim 1, wherein each of the pair of rounded portions has a radius that decreases in a radially inward direction.

3. The baseplate of claim 2, wherein the horizontal portion of each of the legs is substantially contiguous with an underside of the outer annular substantially planar portion of the top plate.

4. The baseplate of claim 3, wherein adjacent ones of the legs include substantially contiguous vertical portions.

5. The baseplate of claim 2, wherein the radius at a most radially distal portion of the rounded portions is no more than about one-half a height of the legs.

6. The baseplate of claim 5, wherein the radius at a most radially proximal portion of the rounded portions is the greater of about twice a thickness of the vertical portion of the legs and about 0.25 inches.

7. The baseplate of claim 2, wherein the top plate and the plurality of legs comprise a composite material.

8. A method of making the baseplate of claim 7, comprising:

separately fabricating the top plate and the plurality of legs; and then joining the plurality of legs to the top plate.

9. The method of claim 8, further comprising using fasteners to join radially proximal portions of the plurality of legs to the hub, the recessed central portion of the top plate, and the socket.

10. The method of claim 8, wherein joining the plurality of legs to the top plate includes joining the horizontal portions of each leg to the underside of the top plate.

11. The method of claim 8, further comprising abutting together the vertical portions of adjacent legs.

12. The method of claim 8, further comprising joining a portion of each of the legs that is radially inward of the horizontal portion of each of the legs to the recessed central portion of the top plate.

13. The baseplate of claim 1, wherein the top plate, socket, hub, and plurality of legs are joined by threaded fasteners.

14. The baseplate of claim 13, wherein each leg includes an opening at a radially proximal portion for receiving one of the threaded fasteners and the hub includes corresponding openings for receiving the threaded fasteners.

15. The baseplate of claim 1, wherein the hub includes slots for receiving radially proximal vertical portions of two adjacent legs.

* * * * *